US011805894B1

(12) United States Patent
Lin

(10) Patent No.: US 11,805,894 B1
(45) Date of Patent: Nov. 7, 2023

(54) ASSEMBLY TABLE

(71) Applicant: Ying-An Lin, Taichung (TW)

(72) Inventor: Ying-An Lin, Taichung (TW)

( * ) Notice: Subject to any disclaimer, the term of this patent is extended or adjusted under 35 U.S.C. 154(b) by 0 days.

(21) Appl. No.: 17/953,965

(22) Filed: Sep. 27, 2022

(30) Foreign Application Priority Data

Jun. 17, 2022 (TW) ..... 111206429

(51) Int. Cl.
*A47B 13/02* (2006.01)

(52) U.S. Cl.
CPC ..... *A47B 13/02* (2013.01); *A47B 2013/026* (2013.01); *A47B 2200/0032* (2013.01)

(58) Field of Classification Search
CPC ..... A47B 13/02; A47B 2013/026; A47B 2013/027; A47B 2200/0032
See application file for complete search history.

(56) References Cited

U.S. PATENT DOCUMENTS 1,477,233 A * 12/1923 Alexander ..... A47C 9/105 248/431
2,710,733 A * 6/1955 Phillips ..... A47B 3/12 248/431
2,841,352 A * 7/1958 Pappas ..... F16M 11/16 126/30
3,275,278 A * 9/1966 Haydock ..... A47B 3/0803 248/431
3,396,933 A * 8/1968 Ward ..... A47B 13/04 297/440.13
5,876,091 A * 3/1999 Chernomashentsev ..... A47K 11/00 297/16.2
8,317,140 B1 * 11/2012 Chung ..... F16M 11/245 248/431
8,418,982 B1 * 4/2013 Vatus ..... A47B 13/02 248/188.7
2014/0338573 A1 * 11/2014 Rassat ..... A47B 13/083 108/150
2022/0034447 A1 * 2/2022 Kaiser ..... A47C 9/105
2022/0061535 A1 * 3/2022 Pao ..... A47C 4/04

FOREIGN PATENT DOCUMENTS

CN 109452756 A * 3/2019 ..... A47B 13/003
DE 102005021521 A1 * 11/2006 ..... A47B 13/04

* cited by examiner

*Primary Examiner* — Daniel J Rohrhoff
(74) *Attorney, Agent, or Firm* — Burris Law, PLLC

(57) ABSTRACT

An assembly table includes a table plate, a table leg unit, a first connecting unit, a first mounting unit and a fastening unit. The table leg unit includes a first leg, a second leg and a third leg that are inclined with respect to the table plate, that intersect one another, and that are detachably mounted to a bottom surface of the table plate. The first connecting unit is detachably connected between the first leg and the second leg. The first mounting unit is detachably connected between the first leg and the third leg. The fastening unit includes a through hole formed through the third leg, and a penetrating fastener removably inserted through the through hole to fix the third leg to the second leg.

9 Claims, 13 Drawing Sheets

ASSEMBLY TABLE

CROSS-REFERENCE TO RELATED APPLICATION

This application claims priority to Taiwanese Utility Model Patent Application No. 111206429, filed on Jun. 17, 2022.

FIELD

The present disclosure relates to a table, and more particularly to an assembly table.

BACKGROUND

A conventional assembly table comprises a plurality of inclined table legs intersecting each another, a table plate disposed on top ends of the table legs, and a plurality of screws securing the table legs to each other.

However, since the number of the components of the conventional assembly table is relatively large, the procedure of assembly and/or disassembly is complicated. In addition, the screws may protrude out of the table legs, which diminishes aesthetics, and increases the risk of scratching when moving or touching the table legs.

SUMMARY

Therefore, an object of the disclosure is to provide an assembly table that can alleviate at least one of the drawbacks of the prior art.

According to the disclosure, the assembly table includes a table plate, a table leg unit, a first connecting unit, a first mounting unit and a fastening unit. The table leg unit includes a first leg, a second leg and a third leg that are inclined with respect to the table plate, that intersect one another, and that are detachably mounted to a bottom surface of the table plate. The first connecting unit is detachably connected between the first leg and the second leg. The first mounting unit is detachably connected between the first leg and the third leg. The fastening unit includes a through hole formed through the third leg, and a penetrating fastener removably inserted through the through hole to fix the third leg to the second leg.

BRIEF DESCRIPTION OF THE DRAWINGS

Other features and effects related to the present disclosure will be clearly presented in the embodying manner with reference to the drawings, in which.

DETAILED DESCRIPTION

Before the present disclosure is described in detail in connection with the drawings and embodiments, it is to be noted that the terms used in the following description to describe relative positions, such as "front", "rear", "left", "right", "upper", "lower", are based on the orientation shown in the figures and the normal use orientation.

Figure 1:
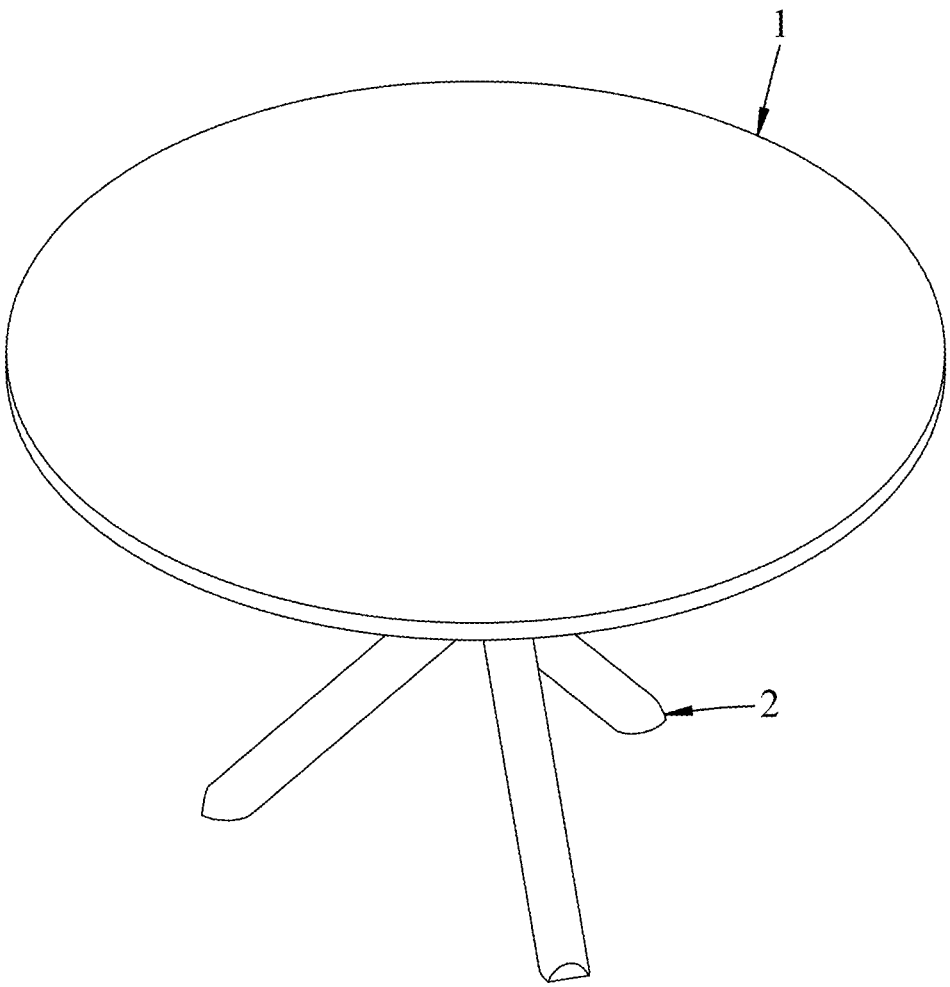
FIG. 1 is an assembled perspective view of an embodiment of an assembly table according the disclosure.
Figure 2:
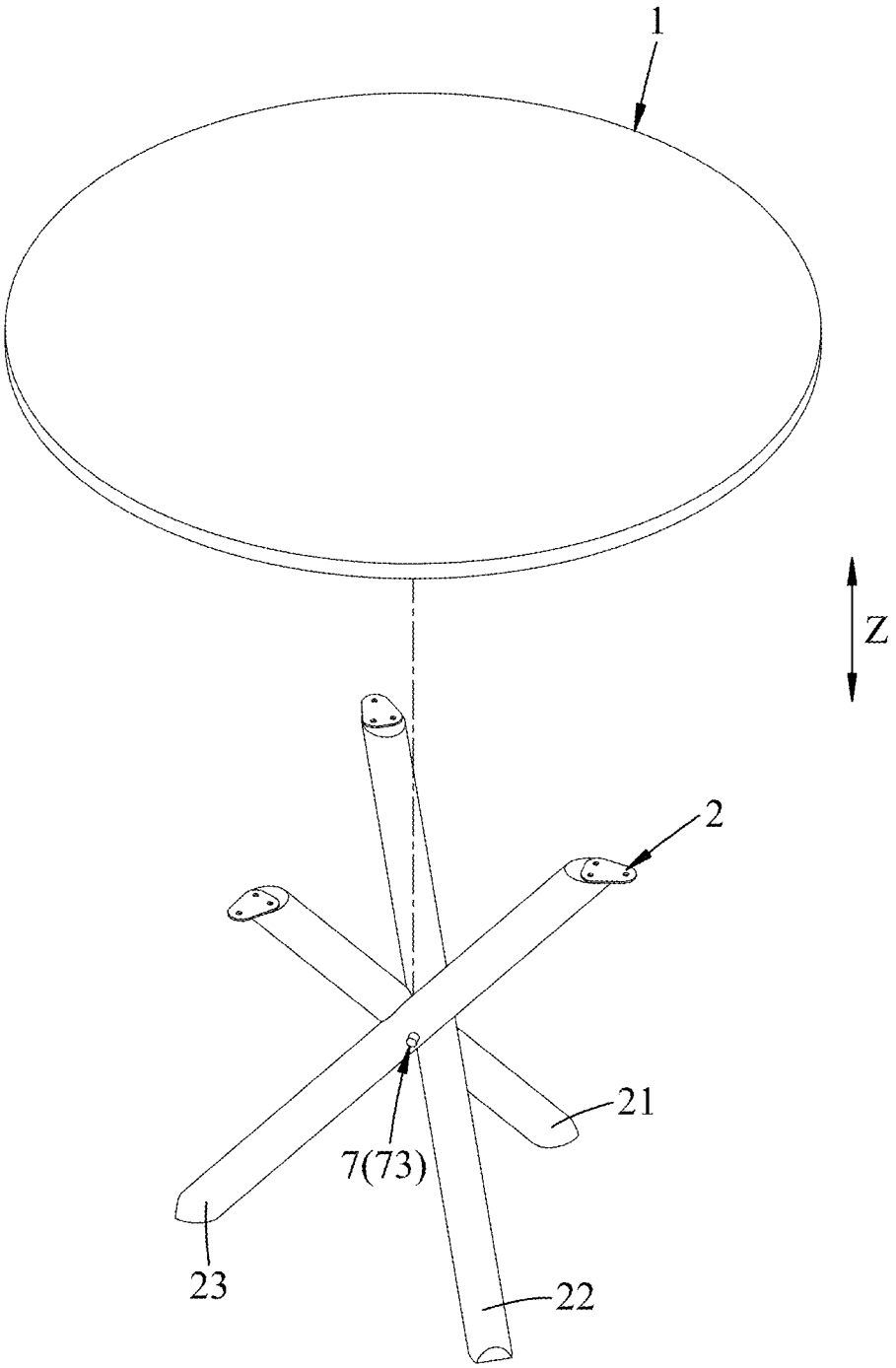
FIG. 2 is a partial exploded perspective view of the embodiment.
Figure 3:
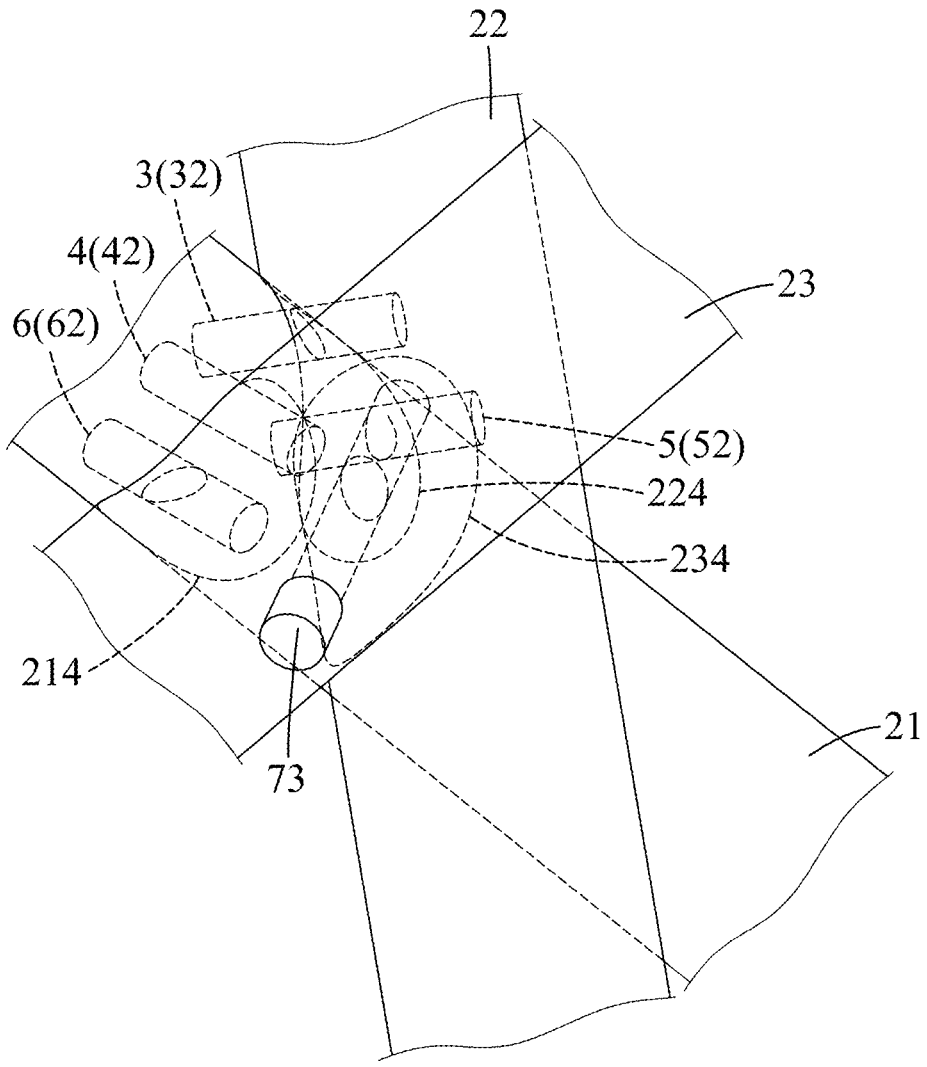
FIG. 3 is an enlarged fragmentary perspective view of the embodiment.

Referring to FIGS. 1 to 3, an embodiment of an assembly table according to the present disclosure includes a table plate 1, a table leg unit 2, a first connecting unit 3, a first mounting unit 4, a second connecting unit 5, a second mounting unit 6, and a fastening unit 7.

Figure 4:
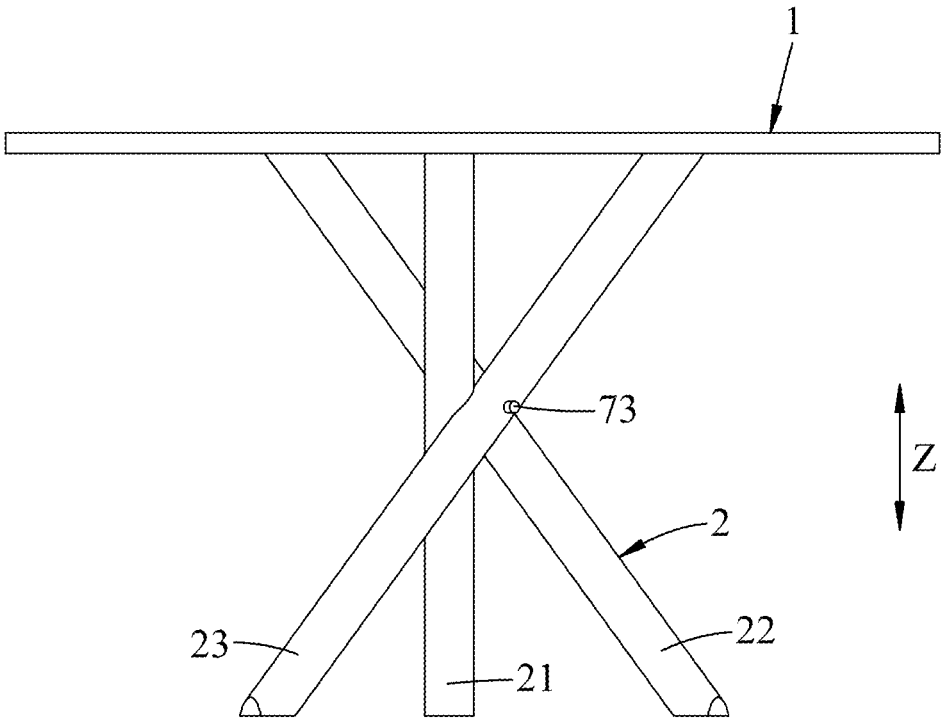
FIG. 4 is a side view of the embodiment.
Figure 5:
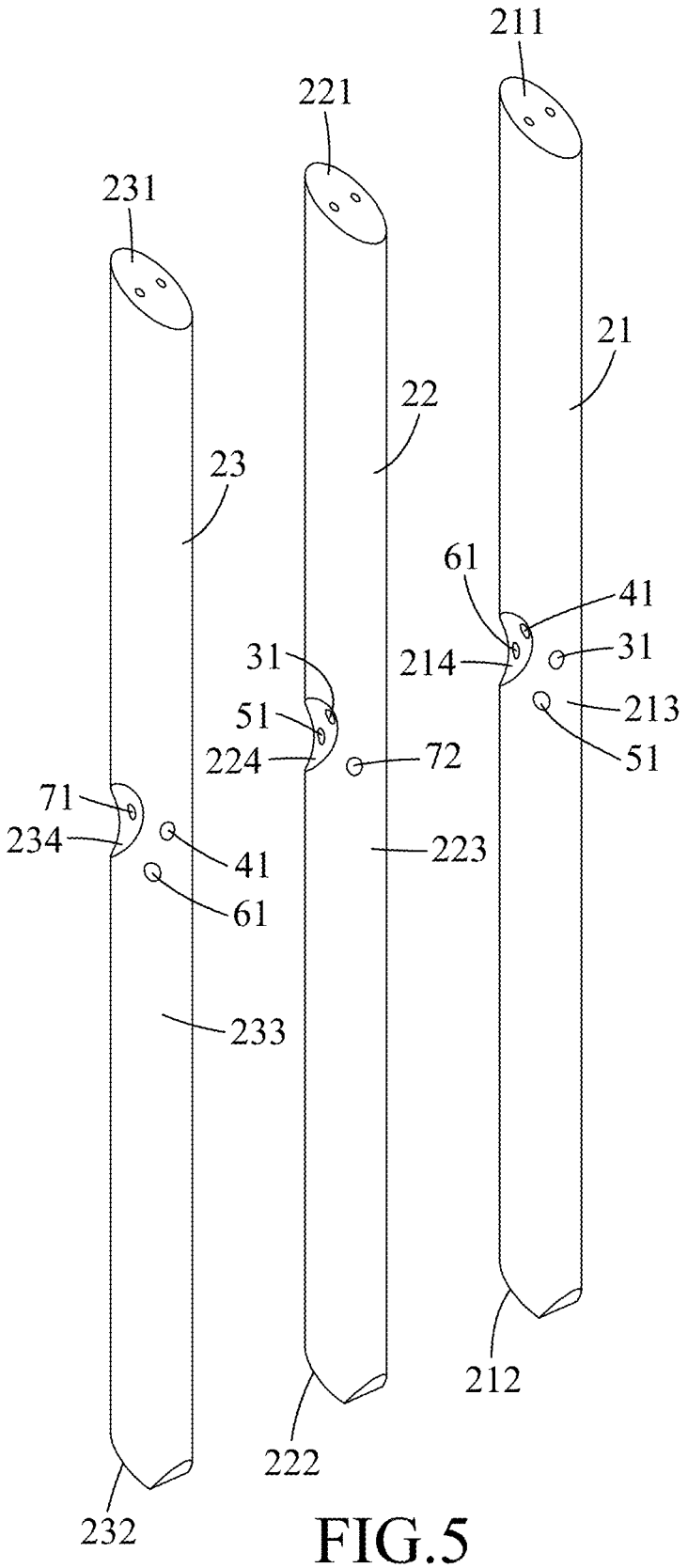
FIG. 5 is a perspective view of a first leg, a second leg and a third leg of the embodiment.
Figure 6:
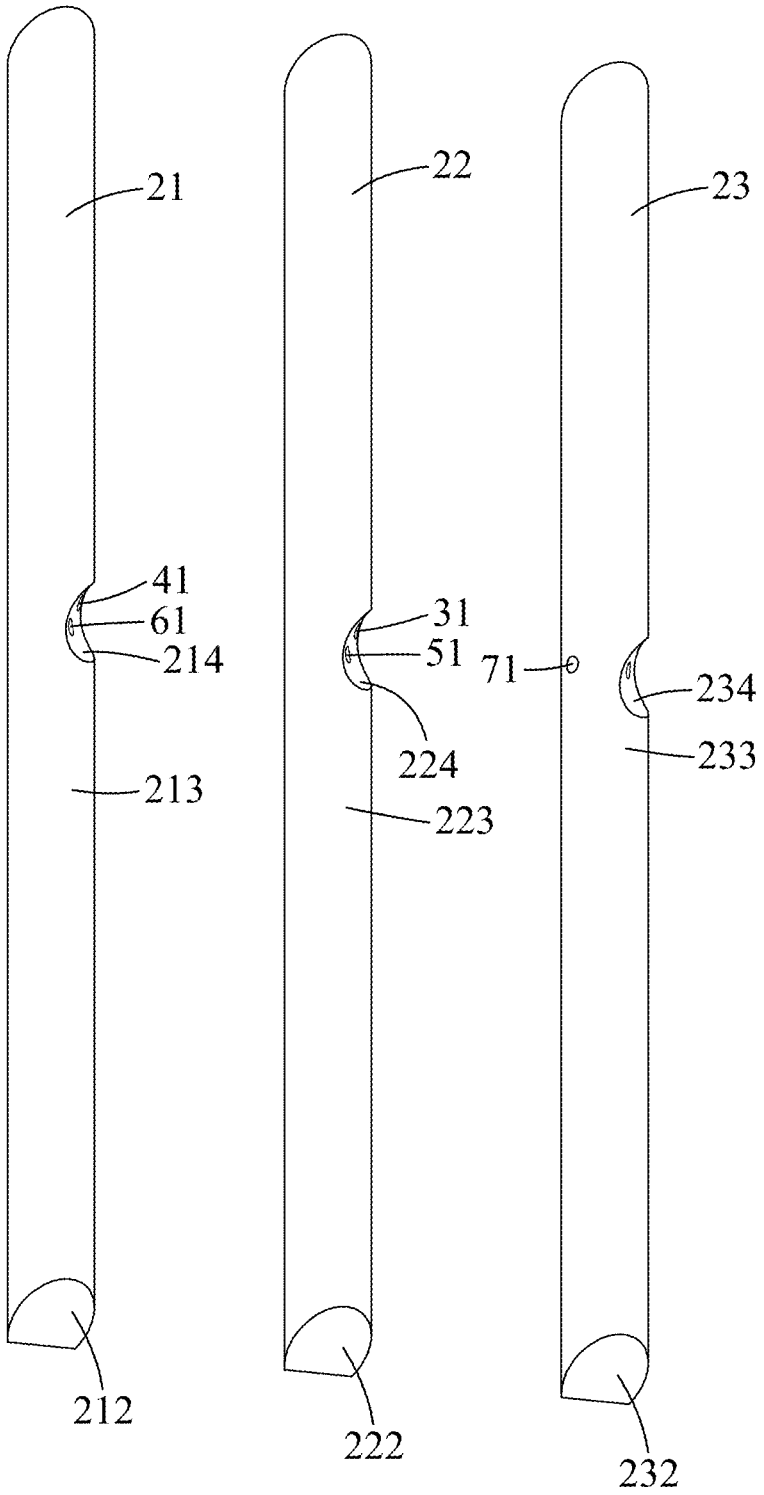
FIG. 6 is another perspective view of the first leg, the second leg and the third leg.
Figure 7:
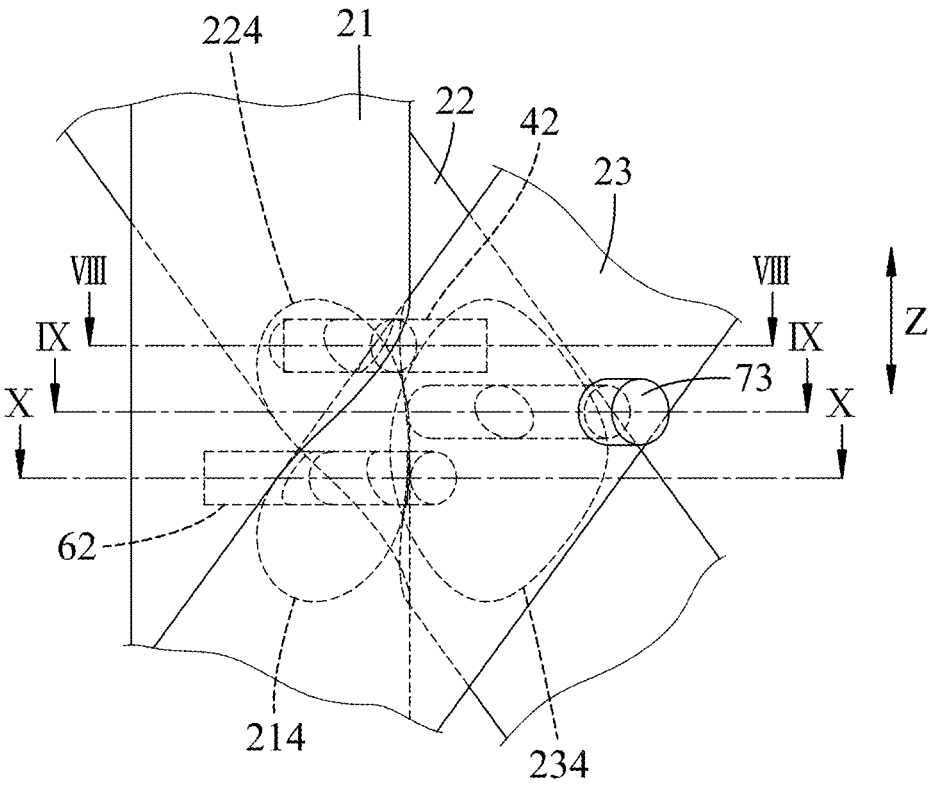
FIG. 7 is another enlarged fragmentary perspective view of the embodiment.
Figure 8:
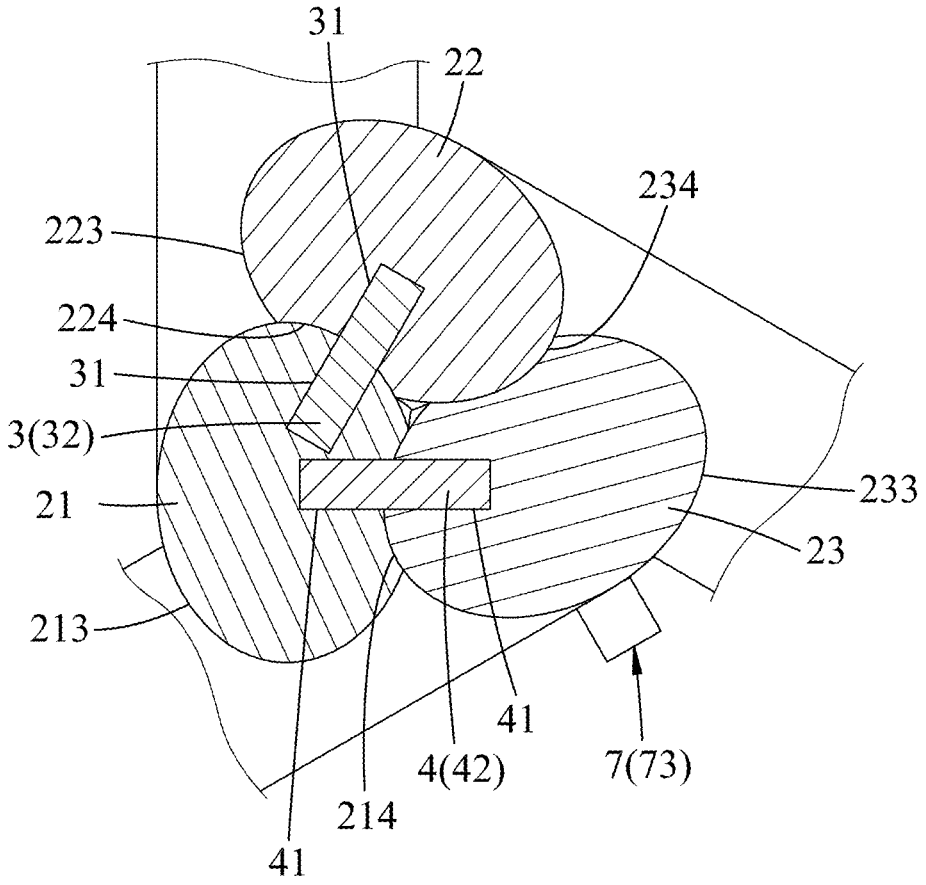
FIG. 8 is a fragmentary sectional view taken along line VIII-VIII in FIG. 7.
Figure 9:
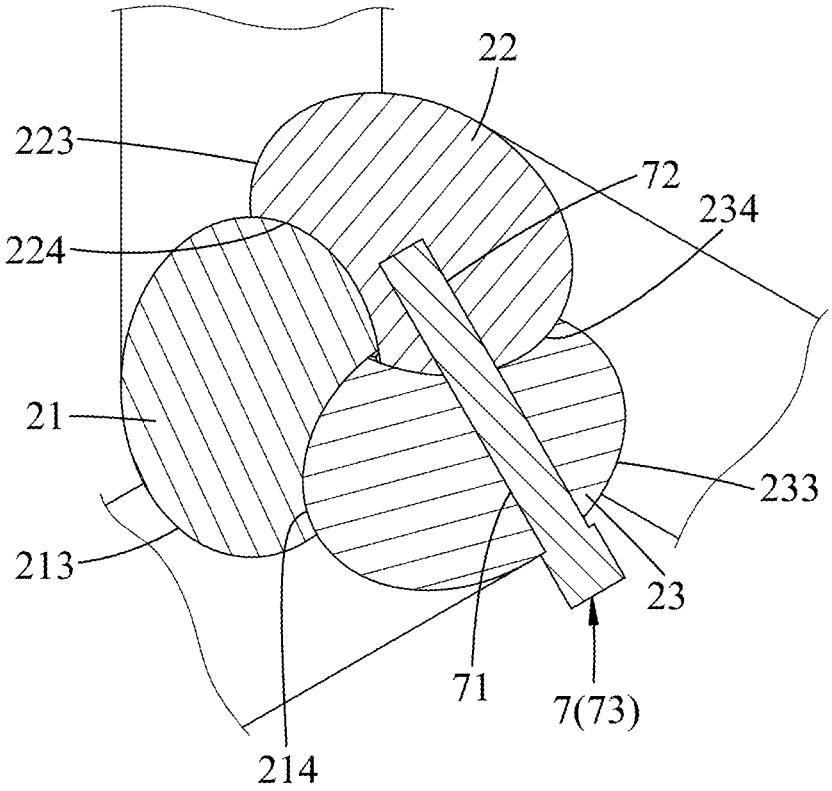
FIG. 9 is a fragmentary sectional view taken along line IX-IX in FIG. 7.
Figure 10:
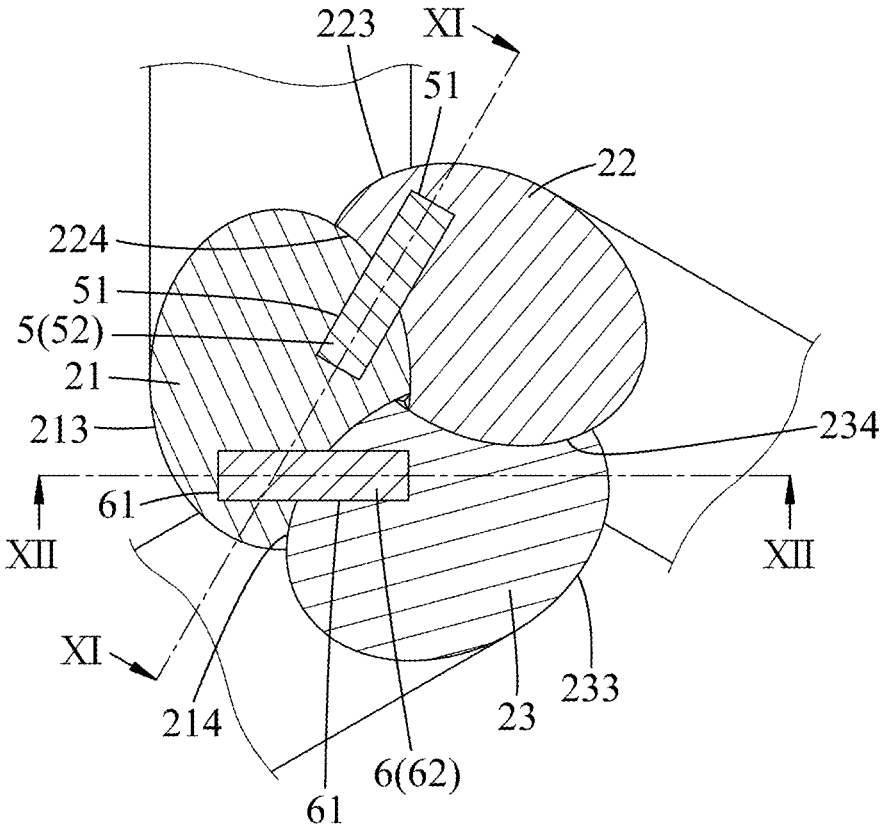
FIG. 10 is a fragmentary sectional view taken along line X-X in FIG. 7.

Referring to FIG. 4 to FIG. 6, the table plate 1 extends horizontally and is perpendicular to a Z-direction (Z).

The table leg unit 2 includes a first leg 21, a second leg 22 and a third leg 23 that are inclined with respect to the table plate 1, that intersect one another, and that are detachably mounted on a bottom surface of the table plate 1.

The first leg 21 has a first upper end surface 11 detachably connected to the table plate 1, a first lower end surface 212 opposite to the first upper end surface 211, a first circumferential surface 213 connected between the first upper end surface 211 and the first lower end surface 212, and a first recessed surface 214 recessed formed on the first circumferential surface 213.

The second leg 22 has a second upper end surface 221 detachably connected to the table plate 1, a second lower end surface 222 opposite to the second upper end surface 221, a second circumferential surface 223 connected between the second upper end surface 221 and the second lower end surface 222, and a second recessed surface 224 recessed formed on the second circumferential surface 223 and abutting against the first circumferential surface 213 of the first leg 21.

The third leg 23 has a third upper end surface 231 detachably connected to the table plate 1, a third lower end surface 232 opposite to the third upper end surface 231, a third circumferential surface 233 connected between the third upper end surface 231 and the third lower end surface 232 and abutting against the first recessed surface 214 of the first leg 21, and a third recessed surface 234 recessed formed on the third circumferential surface 233 and abutting against the second circumferential surface 223 of the second leg 22.

With reference to FIGS. 7 to 10, the first connecting unit 3 is detachably connected between the first leg 21 and the second leg 22. The first connecting unit 3 includes at least one first connecting groove 31 formed in one of the first leg 21 and the second leg 22, and a first connecting member 32 protruding from the other one of the first leg 21 the second leg 22 and detachably inserted into the at least one first connecting groove 31. The first mounting unit 4 is detachably connected between the first leg 21 and the third leg 23. The first mounting unit 4 includes at least one first mounting slot 41 formed in one of the first leg 21 and the third leg 23, and a first mounting member 42 protruding from the other one of the first leg 21 and the third leg 23 and detachably inserted into the at least one first mounting slot 41.

The second connecting unit 5 includes at least one second connecting groove 51 formed in one of the first leg 21 and the second leg 22, and a second connecting member 52 protruding from the other one of the first leg 21 and the second leg 22 and detachably inserted into the at least one second connecting groove 51. The second mounting unit 6 includes at least one second mounting slot 61 formed in one of the first leg 21 and the third leg 23, and a second mounting member 62 protruding from the other one of the first leg 21 and the third leg 23 and detachably inserted into the at least one second mounting slot 61.

In this embodiment, the first connecting member 32, the first mounting member 42, the second connecting member 52, and the second mounting member 62 are respectively elongated latches. Furthermore, the first connecting unit 3 includes two first connecting grooves 31 respectively formed in the first circumferential surface 213 of the first leg 21 and the second recessed surface 224 of the second leg 22, and two opposite ends of the first connecting member 32 are respectively and detachably inserted into the first connecting grooves 31. The first mounting unit 4 includes two first mounting slots 41 respectively formed in the first recessed surface 214 of the first leg 21 and the third circumferential surface 233 of the third leg 23, and two opposite ends of the first mounting member 42 are respectively and detachably inserted into the first mounting slots 41. The second connecting unit 5 includes two second connecting grooves 51 respectively formed in the first circumferential surface 213 of the first leg 21 and the second recessed surface 224 of the second leg 22, and two opposite ends of the second connecting member 52 are respectively and detachably inserted into the second connecting grooves 51. The second mounting unit 6 includes two second mounting slots 61 respectively formed in the first recessed surface 214 of the first leg 21 and the third circumferential surface 233 of the third leg 23, and two opposite ends of the second mounting member 62 are respectively and detachably inserted into the second mounting slots 61.

The fastening unit 7 includes a through hole 71 formed in the third leg 23 and extending through the third circumferential surface 233 to the third recessed surface 234, an engaging groove 72 formed in the second circumferential surface 223 of the second leg 22, and a penetrating fastener 73 detachably inserted through the through hole 71 into the engaging groove 72 to fix the third leg 23 to the second leg 22.

Thus, the first connecting grooves 31, the first connecting member 32, the first mounting slots 41 and the first mounting member 42 are not exposed from the outer side of the table leg unit 2.

Figure 11:
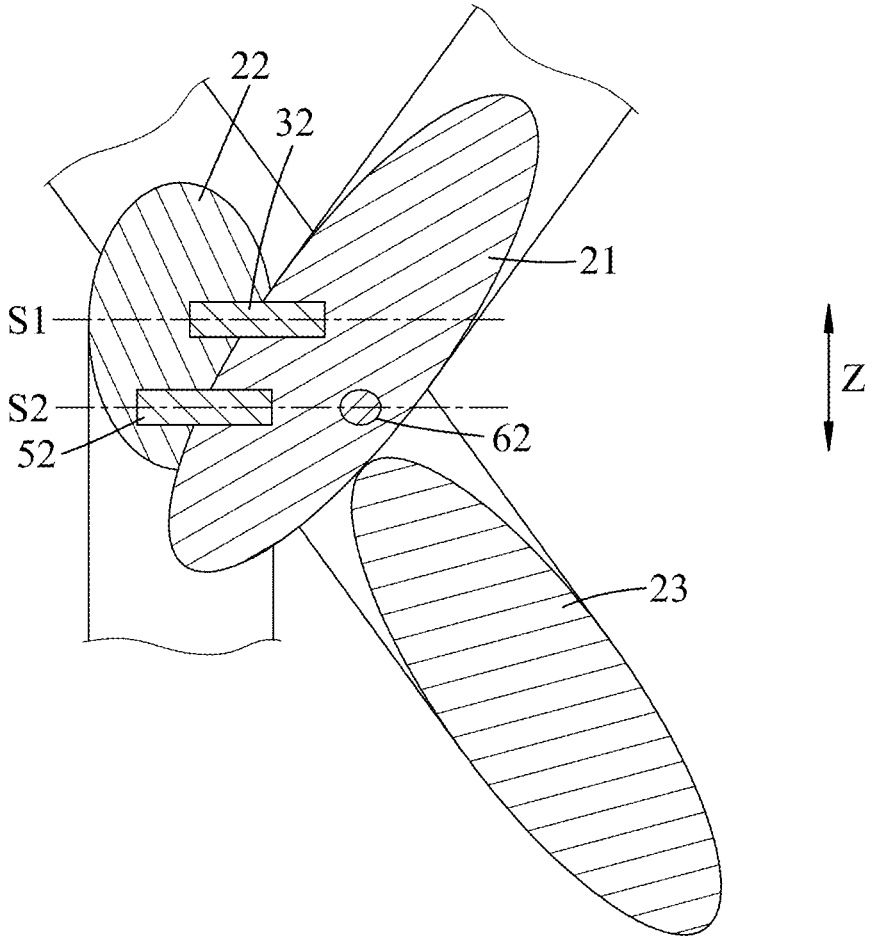
FIG. 11 is a fragmentary sectional view taken along line XI-XI in FIG. 10.
Figure 12:
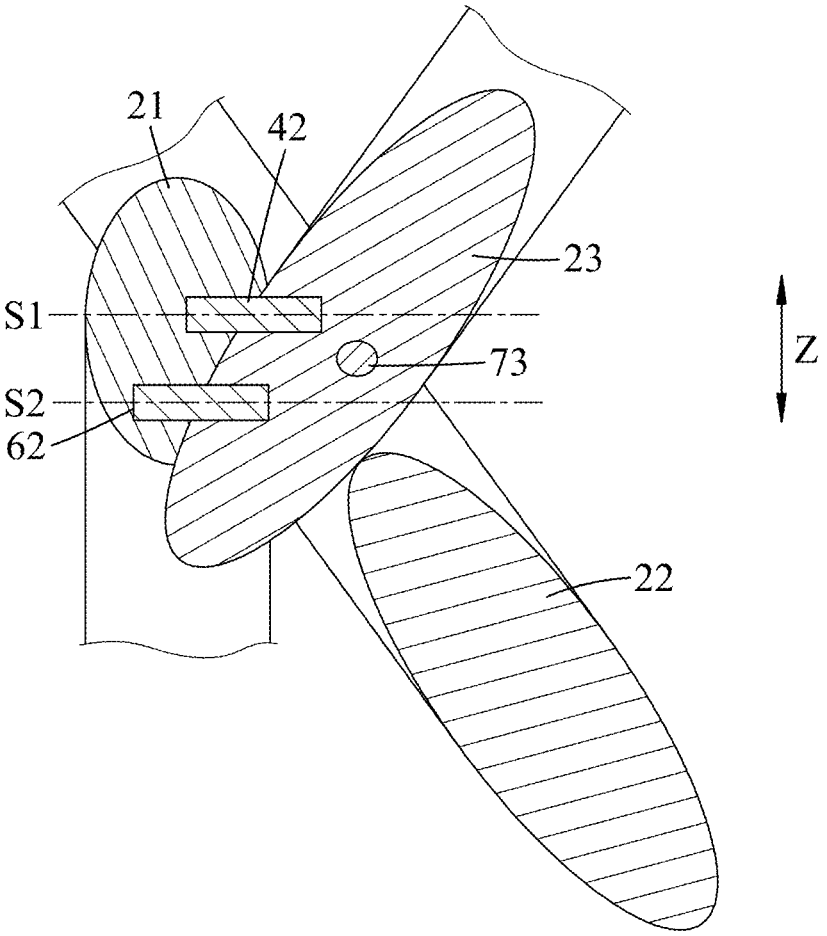
FIG. 12 is a fragmentary sectional view taken along line XII-XII in FIG. 10.
Figure 13:
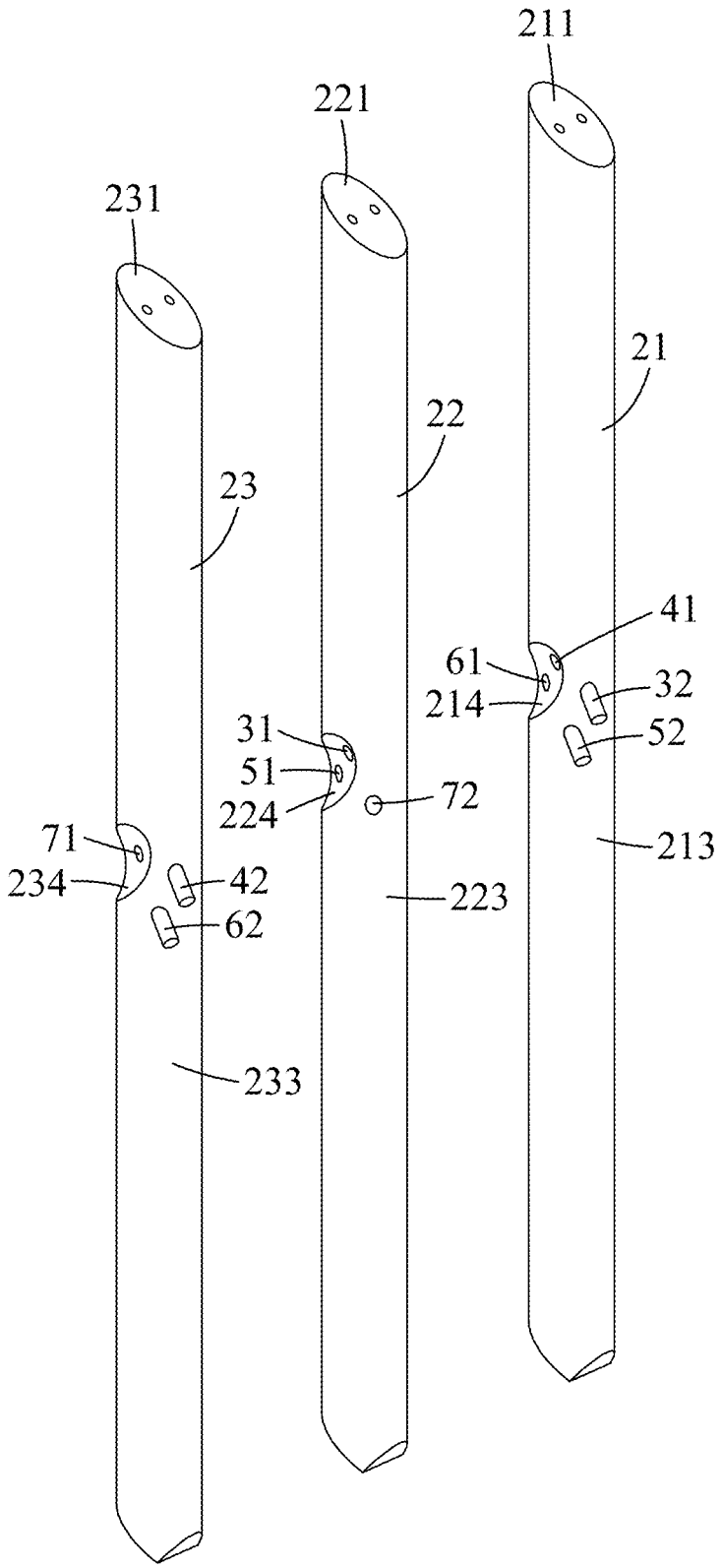
FIG. 13 is a view similar to FIG. 4, illustrating a modification of the embodiment.

Referring to FIG. 11 and FIG. 12, the second connecting member 52 is located below the first connecting member 32 in the Z-direction (Z), and the second mounting member 62 is located below the first mounting member 42 in the Z-direction (Z). Both of the first connecting member 32 and the first mounting member 42 are contained in a first reference plane S1 parallel to the table plate 1. Both of the second connecting member 52 and the second mounting member 62 are contained in a second reference plane S2 parallel to the first reference plane S1 and located below the first reference plane S1. The penetrating fastener 73 is located between the first reference plane S1 and the second reference plane S2.

Referring to FIGS. 8, 9, 10 and 13, in a modification of this embodiment, the number of the first connecting groove 31 may be only one, and the first connecting grooves 31 is formed in one of the first circumferential surface 213 of the first leg 21 and the second recessed surface 224 of the second leg 22. The first connecting member 32 integrally protrudes from the other one of the first circumferential surface 213 of the first leg 21 and the second recessed surface 224 of the second leg 22. The number of the first mounting slot 41 may also be only one, and the first mounting slot 41 is formed in one of the first recessed surface 214 of the first leg 21 and the third circumferential surface 233 of the third leg 23. The first mounting member 42 integrally protrudes from the other one of the first recessed surface 214 of the first leg 21 and the third circumferential surface 233 of the third leg 23.

The number of the second connecting groove 51 may be only one, and the second connecting grooves 51 is formed in one of the first circumferential surface 213 of the first leg 21 and the second recessed surface 224 of the second leg 22. The second connecting member 52 integrally protrudes from the other one of the first circumferential surface 213 of the first leg 21 and the second recessed surface 224 of the second leg 22. The number of the second mounting slot 61 may be only one, and the second mounting slot 61 is formed in one of the first recessed surface 214 of the first leg 21 and the third circumferential surface 233 of the third leg 23. The second mounting member 62 integrally protrudes from the other one of the first recessed surface 214 of the first leg 21 and the third circumferential surfaces 233 of the third leg 23.

For example, in the modification, the first connecting unit 3 includes a first connecting groove 31 formed in the second recessed surface 224 of the second leg 22, and a first connecting member 32 integrally protruding from the first circumferential surface 213 of the first leg 21 and adjacent to the first recessed surface 214. The first mounting unit 4 includes a first mounting slot 41 formed in the first recessed surface 214 of the first leg 21, and a first mounting member 42 integrally protruding from the third circumferential surface 233 of the third leg 23 and adjacent to the third recessed surface 234.

The second connecting unit 5 includes a second connecting groove 51 formed in the second recessed surface 224 of the second leg 22, and a second connecting member 52 integrally protruding from the first circumferential surface 213 of the first leg 21 and adjacent to the first recessed surface 214. The second mounting unit 6 includes a second mounting slot 61 formed in the first recessed surface 214 of the first leg 21, and a second mounting member 62 integrally protruding from the third circumferential surface 233 of the third leg 23 and adjacent to the third recessed surface 234.

In summary, by virtue of the first connecting unit 3 and the second connecting unit 5 each detachably connected between the first leg 21 and the second leg 22, by virtue of the first mounting unit 4 and the second mounting unit 6 each detachably connected between the first leg 21 and the third leg 23, and by virtue of the penetrating fastener 73 detachably inserted through the through hole 71 into the engaging groove 72 to fix the third leg 23 to the second leg 22, so that the first leg 21, the second leg 22 and the third leg 23 of the assembly table according to the disclosure can be stably fixed with each other by fewer components, and the first connecting unit 3, the second connecting unit 5, the first mounting unit 4 and the second mounting unit 6 are not exposed from the outer side of the table leg unit 2, increasing the aesthetic of the table leg unit 2, and reducing the risk of scratching when moving or touching the table leg unit 2.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An assembly table, comprising:

a table plate;

a table leg unit including a first leg, a second leg and a third leg that are inclined with respect to the table plate, that intersect one another, and that are detachably mounted to a bottom surface of the table plate;

a first connecting unit detachably connected between the first leg and the second leg;

a first mounting unit detachably connected between the first leg and the third leg; and a fastening unit including a through hole formed through the third leg, and a penetrating fastener removably inserted through the through hole to fix the third leg to the second leg;

wherein the first connecting unit includes at least one first connecting groove formed in one of the first leg and the second leg, and a first connecting member protruding from the other one of the first leg and the second leg and detachably inserted into the at least one first connecting groove.

2. The assembly table as claimed in claim 1, wherein the first mounting unit includes at least one first mounting slot formed in one of the first leg and the third leg, and a first mounting member protruding from the other one of the first leg and the third leg and detachably inserted into the at least one first mounting slot.

3. The assembly table as claimed in claim 2, wherein the first connecting member integrally protrudes from the other one of the first leg and the second leg, and the first mounting member integrally protrudes from the other one of the first leg and the third leg.

4. The assembly table as claimed in claim 2, wherein:

the first leg has a first upper end surface detachably connected to the table plate, a first lower end surface opposite to the first upper end surface, a first circumferential surface connected between the first upper end surface and the first lower end surface, and a first recessed surface recessed from the first circumferential surface;

the second leg has a second upper end surface detachably connected to the table plate, a second lower end surface opposite to the second upper end surface, a second circumferential surface connected between the second upper end surface and the second lower end surface, and a second recessed surface recessed from the second circumferential surface and abutting against the first circumferential surface;

the third leg has a third upper end surface detachably connected to the table plate, a third lower end surface opposite to the third upper end surface, a third circumferential surface connected between the third upper end surface and the third lower end surface and abutting against the first recessed surface, and a third recessed surface recessed from the third circumferential surface and abutting against the second circumferential surface;

the at least one first connecting groove is formed in one of the first circumferential surface of the first leg and the second recessed surface of the second leg, the first connecting member protruding from the other one of the first circumferential surface of the first leg and the second recessed surface of the second leg;

the at least one first mounting slot is formed in one of the first recessed surface of the first leg and the third circumferential surface of the third leg, the first mounting member protruding from the other one of the first recessed surface of the first leg and the third circumferential surface of the third leg;

the through hole extends through the third circumferential surface and the third recessed surface; and the at least one first connecting groove, the first connecting member, the at least one first mounting slot and the first mounting member are not exposed from the outer side of the table leg unit.

5. The assembly table as claimed in claim 2, further comprising a second connecting unit detachably connected between the first leg and the second leg, the second connecting unit including at least one second connecting groove that is formed in one of the first leg and the second leg, and a second connecting member that protrudes from the other one of the first leg and the second leg and that is detachably inserted into the at least one second connecting groove.

6. The assembly table as claimed in claim 5, further comprising a second mounting unit detachably connected between the first leg and the third leg, the second mounting unit including at least one second mounting slot that is formed in one of the first leg and the third leg, and a second mounting member that protrudes from the other one of the first leg and the third leg and that is detachably inserted into the at least one second mounting slot.

7. The assembly table as claimed in claim 6, wherein:

the first connecting unit includes two of the first connecting grooves respectively formed in the first leg and the second leg and permitting two opposite ends of the first connecting member to be detachably inserted thereinto;

the second connecting unit includes two of the second connecting grooves respectively formed in the first leg and the second leg and permitting two opposite ends of the second connecting member to be detachably inserted thereinto;

the first mounting unit includes two of the first mounting slots respectively formed in the first leg and the third leg and permitting two opposite ends of the first mounting member to be detachably inserted thereinto; and the second mounting unit includes two of the second mounting slots respectively formed in the first leg and the third leg and permitting two opposite ends of the second mounting member to be detachably inserted thereinto.

8. The assembly table as claimed in claim 6, wherein the second connecting member is located below the first connecting member in a Z-direction that is perpendicular to the table plate, and the second mounting member is located below the first mounting member in the Z-direction.

9. The assembly table of claim 6, wherein the first connecting member and the first mounting member are contained in a first reference plane parallel to the table plate, and the second connecting member and the second mounting member are contained in a second reference plane parallel to the first reference plane.

* * * * *